US005765789A

United States Patent [19]

Ryon et al.

[11] Patent Number: 5,765,789

[45] Date of Patent: Jun. 16, 1998

[54] GROCERY STORE GARBAGE BAG SUPPORT APPARATUS

[76] Inventors: Michael Ryon; Curt Timm, both of 7872 Gazette Ave., Winnetka, Calif. 91306

[21] Appl. No.: 733,730

[22] Filed: Oct. 18, 1996

[51] Int. Cl.[6] ..... A63B 55/04; A65B 67/12

[52] U.S. Cl. ..... 248/97; 248/171; 248/95; 248/166

[58] Field of Search ..... 248/97, 100, 95, 248/171, 163.1, 166, 169

[56] References Cited

U.S. PATENT DOCUMENTS

| | | | |
|---|---|---|---|
| 203,891 | 5/1878 | Conway | 248/97 |
| 1,786,308 | 12/1930 | Latourelle et al. | 248/171 X |
| 1,849,898 | 3/1932 | Wright | 248/171 |
| 2,054,600 | 9/1936 | Hoza | 248/167 |
| 2,995,329 | 8/1961 | Talcott, Jr. | 248/97 |
| 3,870,264 | 3/1975 | Robinson | 248/171 |
| 4,562,983 | 1/1986 | Klefbeck | 248/97 |
| 4,856,740 | 8/1989 | MacLeod et al. | 248/97 |
| 4,921,193 | 5/1990 | Benesch | 248/97 |
| 4,981,216 | 1/1991 | Wilfong, Jr. | 248/97 X |
| 5,018,691 | 5/1991 | King | 248/97 X |
| 5,092,548 | 3/1992 | Bayes et al. | 248/95 X |
| 5,125,604 | 6/1992 | Vrooman et al. | 248/97 |
| 5,228,654 | 7/1993 | Carpentier | 248/97 X |
| 5,350,143 | 9/1994 | Hoshino | 248/166 |
| 5,503,356 | 4/1996 | Shelby | 248/166 X |
| 5,562,213 | 10/1996 | Wile | 248/87 X |

FOREIGN PATENT DOCUMENTS

| | | | |
|---|---|---|---|
| 283093 | 3/1915 | Germany | 248/97 |
| 433950 | 8/1926 | Germany | 248/97 |
| 78169 | 12/1918 | Switzerland | 248/87 |

*Primary Examiner*—Peter M. Cuomo
*Assistant Examiner*—Robert J. Sandy

[57] ABSTRACT

A grocery store garbage bag support apparatus including a bag support rack having two pairs of opposed angularly disposed pegs extending upwardly therefrom whereby free ends of the pegs are disposed in a higher plane than that of the bag support rack. A supporting stand is coupled with the bag support rack. The angularly disposed pegs holding handles of a grocery store plastic bag for disposal of refuse.

4 Claims, 3 Drawing Sheets

GROCERY STORE GARBAGE BAG SUPPORT APPARATUS

BACKGROUND OF THE INVENTION

1. Field of the Invention

The present invention relates to a grocery store garbage bag support apparatus and more particularly pertains to supporting grocery store garbage bags in an open configuration to serve as a receptacle for trash with a grocery store garbage bag support apparatus.

2. Description of the Prior Art

The use of plastic garbage bag storage devices is known in the prior art. More specifically, plastic garbage bag storage devices heretofore devised and utilized for the purpose of storing plastic garbage bags for dispensing are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 351,700 to Uzelman discloses a mobile garbage bag support.

U.S. Pat. No. Des. 298,977 to Cook discloses a plastic garbage bag hanger.

U.S. Pat. No. Des. 322,701 to Siewert discloses the ornamental design for a garbage bag rack.

U.S. Pat. No. 5,427,246 to Hadjikhani discloses a shopping bag storage support tube.

U.S. Pat. No. 5,285,927 to Pruitt discloses a container/dispenser for used plastic sacks.

U.S. Pat. No. 5,002,200 to Hunt discloses a method and apparatus for storing used plastic bags for refuse.

While these devices fulfill their respective, particular objective and requirements, the aforementioned patents do not describe a grocery store garbage bag support apparatus for supporting grocery store garbage bags in an open configuration to serve as a receptacle for trash.

In this respect, the grocery store garbage bag support apparatus according to the present invention substantially departs from the conventional concepts and designs of the prior art, and in doing so provides an apparatus primarily developed for the purpose of supporting grocery store garbage bags in an open configuration to serve as a receptacle for trash.

Therefore, it can be appreciated that there exists a continuing need for new and improved grocery store garbage bag support apparatus which can be used for supporting grocery store garbage bags in an open configuration to serve as a receptacle for trash. In this regard, the present invention substantially fulfills this need.

SUMMARY OF THE INVENTION

In the view of the foregoing disadvantages inherent in the known types of plastic garbage bag storage devices now present in the prior art, the present invention provides an improved grocery store garbage bag support apparatus. As such, the general purpose of the present invention, which will be described subsequently in greater detail, is to provide a new and improved grocery store garbage bag support apparatus and method which has all the advantages of the prior art and none of the disadvantages.

To attain this, the present invention essentially comprises a bag support rack comprised of a planar back support. The planar back support has a cylindrical collar extending downwardly from a lower edge thereof. The cylindrical collar is internally threaded. The bag support includes a cylindrical U-shaped support. The U-shaped support has free ends secured to a front face of the planar support back in an orthogonal relationship with respect thereto. Two side supports of the U-shaped support each have a pair of angularly disposed pegs extending upwardly therefrom whereby free ends of the pegs are disposed in a higher plane than that of the U-shaped support. Each peg has a rubber cap coupled to its free end. The apparatus includes a supporting stand comprising a cylindrical upper linear extent, a cylindrical lower linear extent and foldable tripod legs. The upper linear extent has an upper end with external threads thereon. The upper end is removably coupled with the cylindrical collar of the bag support rack. A lower end of the upper linear extent is slidably received within an open upper end of the lower linear extent. An adjustment collar adjustably couples the upper linear extent within the lower linear extent. A lower end of the lower linear extent has a tripod support collar slidably disposed thereon. The tripod support collar has three foldable legs extending downwardly therefrom. Upper ends of the three foldable legs are secured within the tripod support collar by a triangular bracket. Lower ends of the three foldable legs have rubber caps disposed thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved grocery store garbage bag support apparatus which has all the advantages of the prior art plastic garbage bag storage devices and none of the disadvantages.

It is another object of the present invention to provide a new and improved grocery store garbage bag support apparatus which may be easily and efficiently manufactured and marketed.

It is a further object of the present invention to provide a new and improved grocery store garbage bag support apparatus which is of durable and reliable construction.

An even further object of the present invention is to provide a new and improved grocery store garbage bag support apparatus which is susceptible of a low cost of manufacture with regard to both materials and labor, and which accordingly is then susceptible of low prices of sale to the consuming public, thereby making such a grocery store garbage bag support apparatus economically available to the buying public.

Even still another object of the present invention is to provide a new and improved grocery store garbage bag support apparatus for supporting grocery store garbage bags in an open configuration to serve as a receptacle for trash.

Lastly, it is an object of the present invention to provide a new and improved grocery store garbage bag support apparatus including a bag support rack having two pairs of opposed angularly disposed pegs extending upwardly therefrom whereby free ends of the pegs are disposed in a higher plane than that of the bag support rack. A supporting stand is coupled with the bag support rack. The angularly disposed pegs holding handles of a grocery store plastic bag for disposal of refuse.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
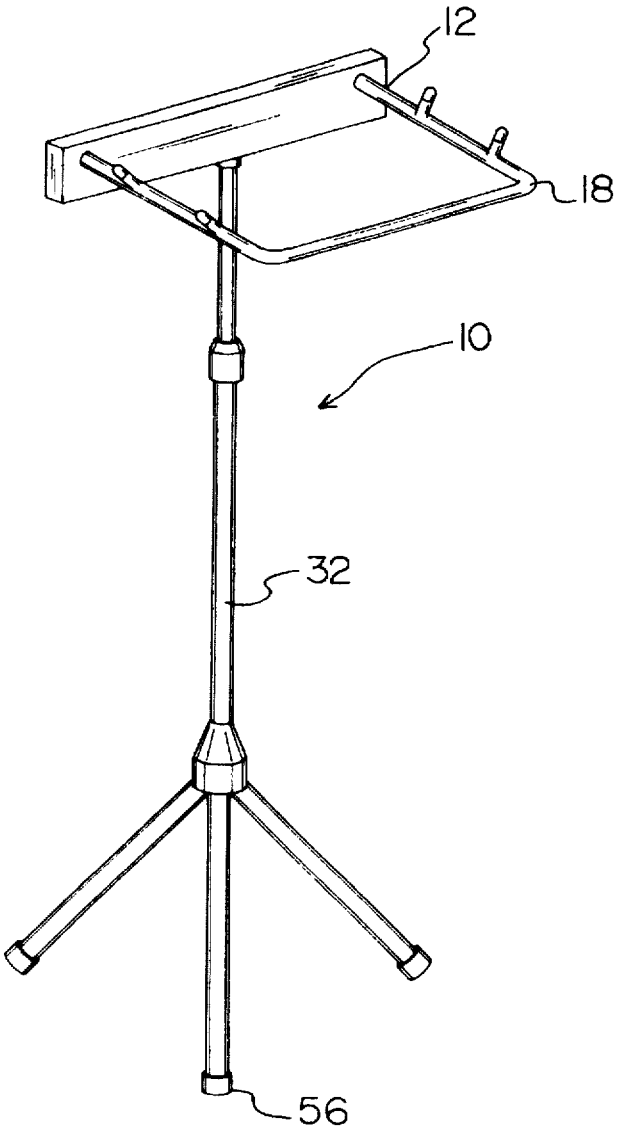
FIG. 1 is a perspective view of the preferred embodiment of the grocery store garbage bag support apparatus constructed in accordance with the principles of the present invention.
Figure 2:
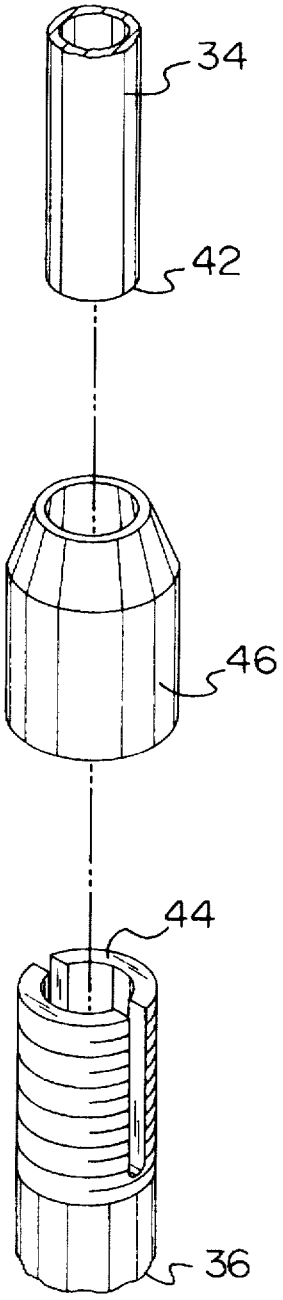
FIG. 2 s an isolated view of the height adjustable components of the present invention.
Figure 3:
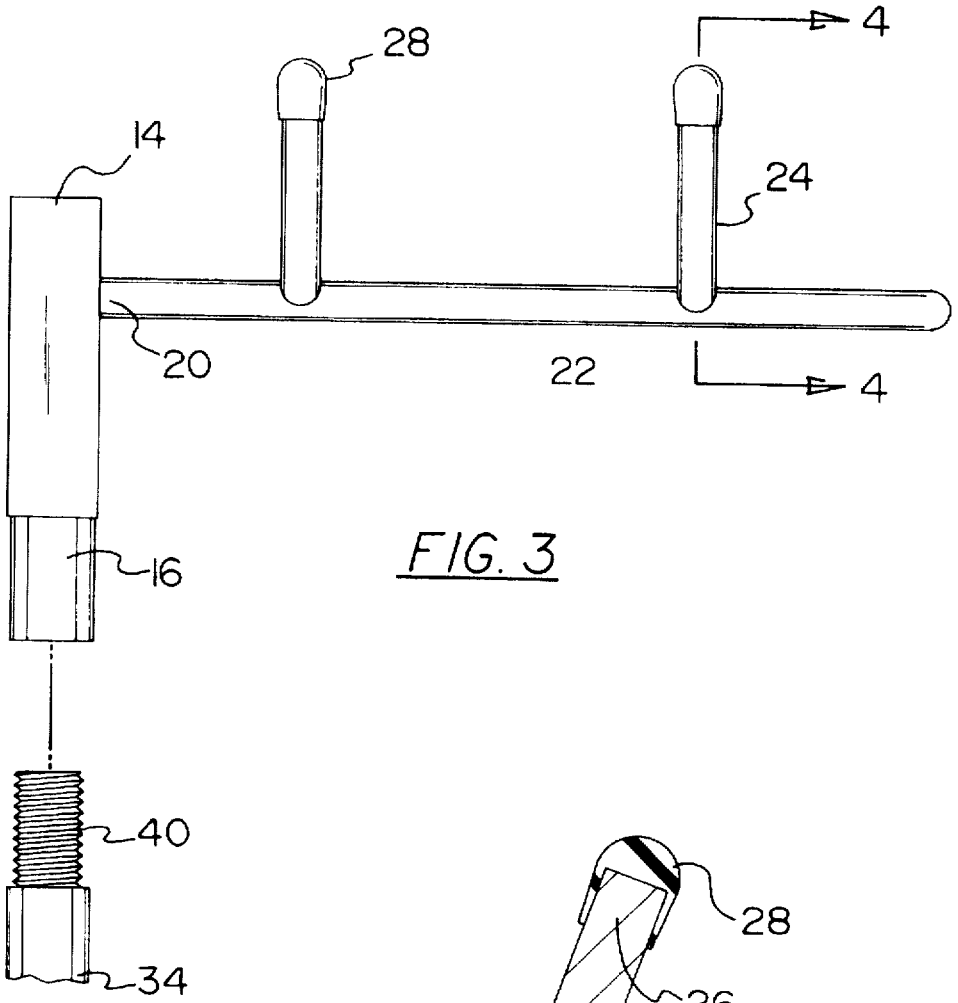
FIG. 3 is a side elevation view of the bag support rack of e present invention.
Figure 4:
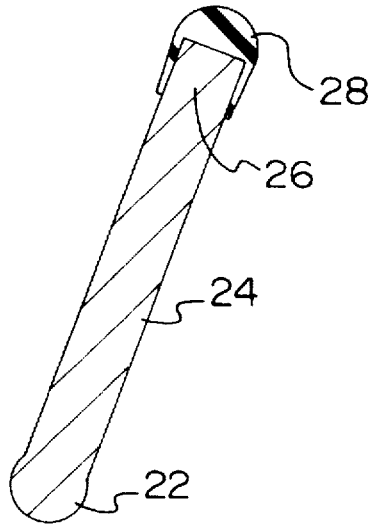
FIG. 4 is a cross-sectional view as taken along line 4—4 of FIG. 3.
Figure 5:
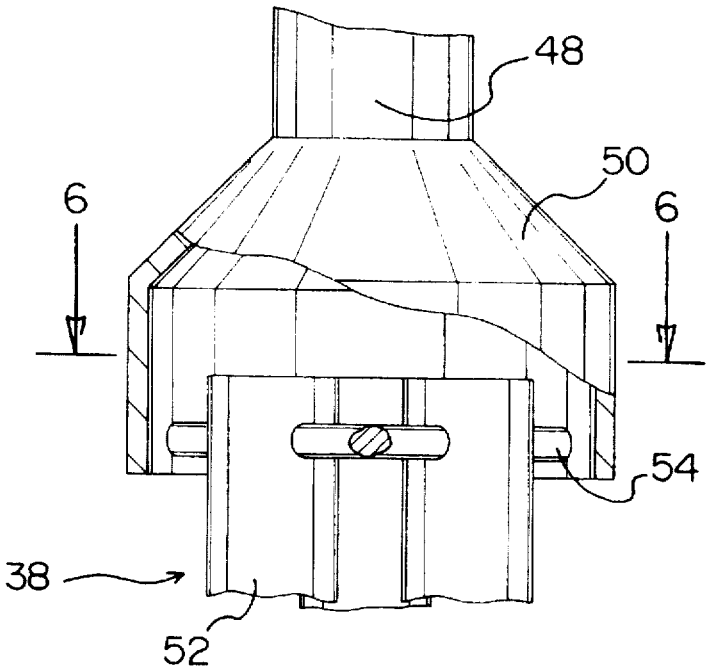
FIG. 5 is a sectional front view of the present invention illustrating the tripod collar.
Figure 6:
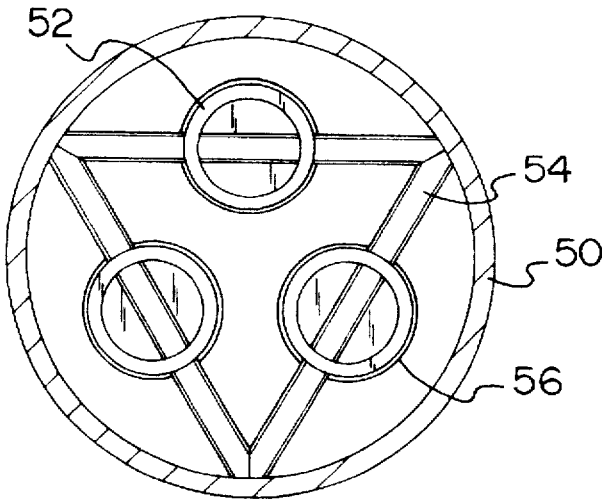
FIG. 6 is a cross-sectional view as taken along line 6—6 of FIG. 5.

With reference now to the drawings, and in particular, to FIGS. 1 through 6 thereof, the preferred embodiment of the new and improved grocery store garbage bag support apparatus embodying the principles and concepts of the present invention and generally designated by the reference number 10 will be described.

Specifically, it will be noted in the various Figures that the device relates to a grocery store garbage bag support apparatus for supporting grocery store garbage bags in an open configuration to serve as a receptacle for trash. In its broadest context, the device consists of a bag support rack and a support stand. Such components are individually configured and correlated with respect to each other so as to attain the desired objective.

The apparatus 10 includes a bag support rack 12 comprised of a planar back support 14. The planar back support 14 has a cylindrical collar 16 extending downwardly from a lower edge thereof. The cylindrical collar 16 is internally threaded. The bag support rack 12 includes a cylindrical U-shaped support 18. The U-shaped support 18 has free ends 20 secured to a front face of the planar back support 14 in an orthogonal relationship with respect thereto. Two side supports 22 of the U-shaped support 18 each have a pair of angularly disposed pegs 24 extending upwardly therefrom whereby free ends 26 of the pegs 24 are disposed in a higher plane than that of the U-shaped support 18. Each peg 24 has a rubber cap 28 coupled to its free end 26. In use, the plastic bags that groceries from the grocery store are used for holding and transporting the groceries are reused to hold refuse in a home. A single plastic bag is dropped between the planar back support 14 and the U-shaped support 18 with opposing handles of the plastic bag draped over the pegs 24. The two side supports 22 are spaced sufficiently to allow for the plastic bag to open to utilized its entire capacity.

Associated with the bag support rack 12, the apparatus 10 includes a supporting stand 32 comprising a cylindrical upper linear extent 34, a cylindrical lower linear extent 36 and foldable tripod legs 38. The upper linear extent 34 has an upper end 40 with external threads thereon. The upper end 40 is removably coupled with the cylindrical collar 16 of the bag support rack 12. A lower end 42 of the upper linear extent 34 is slidably received within an open upper end 44 of the lower linear extent 36. An adjustment collar 46 adjustably couples the upper linear extent 34 within the lower linear extent 36. To alter the height of the supporting stand 32, the adjustment collar 46 is loosened to allow the upper linear extent 34 to freely slide within the lower linear extent 36 until the desired height is reached. The adjustment collar 46 is then tightened to hold the apparatus 10 at the desired height. Such a feature is desirable to prevent children and pets from having access to the refuse within the plastic bags. A lower end 48 of the lower linear extent 36 has a tripod support collar 50 slidably disposed thereon. The tripod support collar 50 has three foldable legs 52 extending downwardly therefrom. Upper ends of the three foldable legs 52 are secured within the tripod support collar 50 by a triangular bracket 54. Lower ends of the three foldable legs 52 have rubber caps 56 disposed thereon. The foldable legs 52 can simply be raised together for storage purposes by lifting upwardly on the tripod support collar 50.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A grocery store garbage bag support apparatus for supporting grocery store garbage bags in an open configuration to serve as a receptacle for trash comprising, in combination:

a bag support rack comprised of a planar back support, the planar back support having a cylindrical collar extending downwardly from a lower edge thereof, the cylindrical collar being internally threaded, the bag support rack including a cylindrical U-shaped support, the U-shaped support having free ends secured to a front face of the planar back support in an orthogonal relationship with respect thereto, two side supports of the U-shaped support each having a pair of angularly disposed pegs extending upwardly therefrom whereby free ends of the pegs are disposed in a higher plane than that of the U-shaped support, each peg having a rubber cap coupled to its free end; and a supporting stand comprising a cylindrical upper linear extent, a cylindrical lower linear extent and foldable tripod legs, the upper linear extent having an upper end with external threads thereon, the upper end removably coupled with the cylindrical collar of the bag support rack, a lower end of the upper linear extent slidably received within an open upper end of the lower linear extent, an adjustment collar adjustably couples the upper linear extent within the lower linear extent, a lower end of the lower linear extent having a tripod support collar slidably disposed thereon, the tripod support collar having three foldable legs extending downwardly therefrom, upper ends of the three foldable legs secured within the tripod support collar by a triangular bracket, lower ends of the three foldable legs having rubber caps disposed thereon.

2. A grocery store garbage baa support apparatus comprising:

a bag support rack having two pairs of opposed angularly disposed peas extending upwardly therefrom whereby free ends of the peas are disposed in a higher plane than that of the bag support rack;

a supporting stand coupled with the bag support rack;

wherein the bag support rack comprised of a planar back support, the planar back support having a cylindrical collar extending downwardly from a lower edge thereof for coupling to the supporting stand, the bag support rack including a cylindrical U-shaped support, the U-shaped support having free ends secured to a front face of the planar back support in an orthogonal relationship with respect thereto, two side supports of the U-shaped support each having a pair of the angularly disposed pegs extending upwardly therefrom.

3. A grocery store garbage bag support apparatus comprising:

a bag support rack having two pairs of opposed angularly disposed pegs extending upwardly therefrom whereby free ends of the pegs are disposed in a higher plane than that of the bag support rack;

a supporting stand coupled with the bag support rack;

wherein the supporting stand having height adjustment means;

wherein an upper linear extent of the supporting stand having an upper end removably coupled with to the bag support rack, a lower end of the upper linear extent slidably received within an open upper end of a lower linear extent of the supporting stand, an adjustment collar adjustably couples the upper linear extent within the lower linear extent, a lower end of the lower linear extent having a tripod support collar slidably disposed thereon, the tripod support collar having three foldable legs extending downwardly therefrom, upper ends of the three foldable legs secured within the tripod support collar by a triangular bracket.

4. The apparatus as set forth in claim 3 wherein lower ends of the three foldable legs having rubber caps disposed thereon.

* * * * *